US009863421B2

(12) United States Patent
Utpat et al.

(10) Patent No.: US 9,863,421 B2
(45) Date of Patent: Jan. 9, 2018

(54) PULSATION DAMPENING ASSEMBLY

(71) Applicant: Emerson Climate Technologies, Inc., Sidney, OH (US)

(72) Inventors: Ajay Utpat, Pune (IN); Vinayak Juge, Pune (IN); Prashant Mogal, Pune (IN); Brian Butler, Centerville, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 254 days.

(21) Appl. No.: 14/665,442

(22) Filed: Mar. 23, 2015

(65) Prior Publication Data

US 2015/0300353 A1 Oct. 22, 2015

(30) Foreign Application Priority Data

Apr. 19, 2014 (IN) ..... 1411/MUM/2014

(51) Int. Cl.

| | |
|---|---|
| ***F16L 55/04*** | (2006.01) |
| ***F04C 29/00*** | (2006.01) |
| ***F04C 18/02*** | (2006.01) |
| ***F04C 29/06*** | (2006.01) |
| ***F04C 29/12*** | (2006.01) |

(52) U.S. Cl.

CPC ..... *F04C 29/0035* (2013.01); *F04C 18/0207* (2013.01); *F04C 29/06* (2013.01); *F04C 29/12* (2013.01)

(58) Field of Classification Search

USPC ..... 138/31, 43, 46

See application file for complete search history.

(56) References Cited

U.S. PATENT DOCUMENTS 3,419,030 A * 12/1968 Gratzmuller ..... B66F 3/42 137/102
4,706,705 A * 11/1987 Lee, II ..... F16K 15/044 137/454.2

(Continued)

FOREIGN PATENT DOCUMENTS

CN 1289011 A 3/2001
CN 1369646 A 9/2002

(Continued)

OTHER PUBLICATIONS

Office Action regarding Chinese Patent Application No. 201510175397.2, dated Nov. 1, 2016. Translation provided by Unitalen Attorneys at Law.

*Primary Examiner* — James Hook
(74) *Attorney, Agent, or Firm* — Harness, Dickey & Pierce, P.L.C.

(57) ABSTRACT

The present disclosure provides a pulsation dampening assembly for a compressor having an outlet port configured for supplying compressed refrigerant from a compression mechanism of the compressor. The pulsation dampening assembly includes a pulsating disc and a spring. The pulsating disc and the spring are disposed within the outlet port. The pulsating disc includes a plurality of apertures in fluid communication with the compression mechanism. The spring includes a first end engaging the pulsating disc and a second end engaging the outlet port. The pulsating disc is translatably disposed within the outlet port between an operative state and an inoperative state.

20 Claims, 11 Drawing Sheets

(56) References Cited

U.S. PATENT DOCUMENTS

| | | | | |
|---|---|---|---|---|
| 5,210,382 | A * | 5/1993 | Paley | F16L 55/053 138/30 |
| 5,740,837 | A * | 4/1998 | Chiang | G05D 16/0602 138/31 |
| 6,513,545 | B2 * | 2/2003 | Rhone | F16K 17/30 137/460 |
| 8,807,667 | B2 * | 8/2014 | Park | B60T 13/166 138/31 |
| 2010/0288388 | A1 * | 11/2010 | Barale | B62D 5/062 138/31 |

FOREIGN PATENT DOCUMENTS

| | | | |
|---|---|---|---|
| CN | 101173654 | A | 5/2008 |
| CN | 204755315 | U | 11/2015 |
| JP | H08320171 | A | 12/1996 |

* cited by examiner

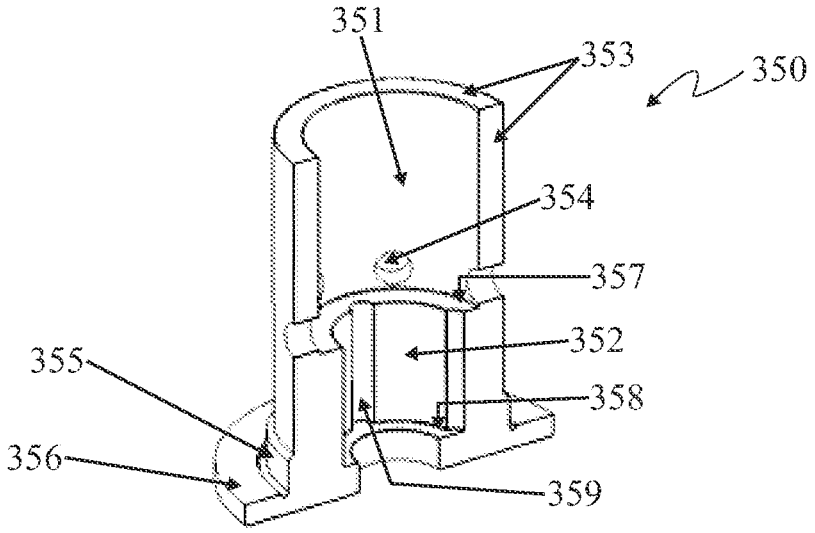
FIGURE 3a
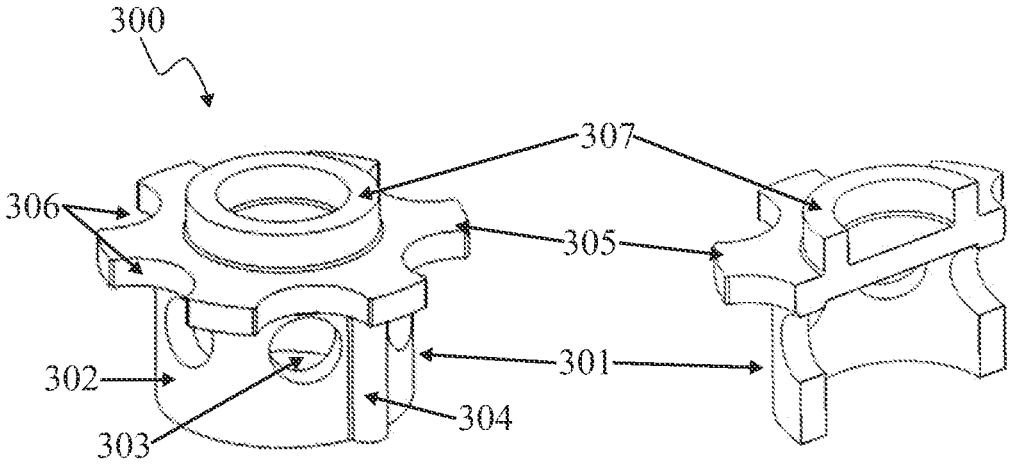
FIGURE 3b
FIGURE 3c

PULSATION DAMPENING ASSEMBLY

CROSS-REFERENCE TO RELATED APPLICATIONS

This application claims the benefit and priority of Indian Patent Application No. 1411/MUM/2014, filed Apr. 19, 2014. The entire disclosure of the above application is incorporated herein by reference.

FIELD

The present disclosure relates to a compressor, and more particularly to reducing pressure pulsations in a compressor.

BACKGROUND

This section provides background information related to the present disclosure and is not necessarily prior art.

A compressor is one of the most important pieces of equipment used in an HVAC (Heating, Ventilation and Air-Conditioning) system. Compressors are used to control the circulation of refrigerant within the HVAC system, by drawing in refrigerant at low pressure and low temperature and delivering it at a higher pressure and temperature to the system. Depending on the capacity requirements of HVAC applications, different compressors are used such as reciprocating and rotary, including scroll compressors, screw compressors, and the like.

Reciprocating compressors typically have one or more pistons that are used to compress refrigerant to increase its pressure. Reciprocating compressors use the reciprocating action of a piston inside a cylinder to compress refrigerant. The piston is driven up/down or back/forth by a crankshaft. The cylinder includes an inlet and an outlet for entry of refrigerant and exit of compressed refrigerant respectively. Refrigerant entering the cylinder through the inlet is compressed by an upward movement of the piston in the cylinder. As the piston is driven upward in the cylinder, refrigerant in the cylinder is compressed prior to exiting out of the cylinder through the outlet when the required compression pressure has been achieved.

Scroll compressors include two disks, each including a spiral wrap. The spiral wraps of the two disks are nested together, wherein a first disk is stationary and a second disk is moving around the first in an orbital fashion. Refrigerant is sucked in through an inlet typically located at the perimeter of the nested disk arrangement and gets trapped in a space between the two nested disks. As the second disk moves in relation to the first disk, refrigerant in the space between the disks is compressed and reaches a high pressure and temperature. Compressed refrigerant is then discharged through an outlet typically located at the center of the first disk.

Compressed refrigerant then enters a piping system for being transported to other equipment connected to the compressor of the HVAC system where it is needed. The aforementioned methods of operation cause compressed refrigerant to be delivered to the piping system or other equipment in pulses instead of a continuous flow. As a result, compressed refrigerant, when being discharged into a small volume such as a short pipe, can cause pressure fluctuations in the associated piping system. Several undesirable effects of pressure fluctuations appear in the piping system and/or the equipment connected to the compressor or within the compressor itself. All of these undesirable effects are due to discharge pulsations which appear as a result of the pulsating action of the compressing means such nested disks, a piston, or the like. A major drawback which arises from discharge pulsations is the effect of vibration such as rattling which appears in the piping system and/or other equipment connected to the compressor, and can potentially damage the piping system and/or the equipment connected to the compressor. When the discharge pulsations are severe, the vibration/rattling is frequently accompanied by considerable noise, which radiates from the piping system. Severe discharge pulsations can also considerably decrease the efficiency of the compressor.

In order to absorb or dampen the pressure fluctuations, an oversized piping system is typically used. However, an oversized piping system results in heavier pipes, which can lead to maintenance issues and cost escalation. Another alternative is to provide a discharge cavity at the outlet of the compressing means whereby the volume of the cavity facilitates a reduction in the discharge pulsations. However, in order to provide a discharge cavity, the size of the shell/housing of the compressor needs to be increased, thereby making the compressor heavy, large, and difficult to service. Additionally, a discharge muffler is typically coupled to the outlet of the compressor to attenuate discharge pulsations generated by the compressor. However, acoustic characteristics of the discharge muffler are extremely important in achieving efficient pulsation dampening. Furthermore, existing discharge mufflers may share a large partition with the suction/inlet portion of the compressor. The high temperature of the discharge muffler can transfer heat to the inlet portion of the compressor and decrease the efficiency of the compressor.

Hence, there is a need for a mechanism that can effectively dampen discharge pulsations while occupying less space and increasing the efficiency of the compressor.

SUMMARY

This section provides a general summary of the disclosure, and is not a comprehensive disclosure of its full scope or all of its features.

In accordance with one aspect of the present disclosure, a pulsation dampening assembly for compressors is provided. The pulsation dampening assembly is adapted to be disposed in an outlet port configured in a housing of a compressor for supplying compressed refrigerant outside the compressor. The pulsation dampening assembly includes an insert, a first helical spring, a second helical spring, and a pulsating disc. The insert may be adapted to be attached to the outlet port. The insert may include a base, a wall extending from the base, and a through-hole defined by a first diameter portion and a second diameter portion of the wall. The first diameter portion may include a plurality of first apertures located adjacent to said second diameter portion. The base may abut the housing of the compressor when the insert is attached within the outlet port. The first helical spring and the second helical spring may be co-axially spaced apart within the through-hole of the insert. The pulsating disc positioned between the first and second helical springs in the through-hole. The disc may include a cylindrically shaped lower portion, a flange, and a spring supporter. The cylindrically shaped lower portion may include an open bottom end for facilitating entry of compressed refrigerant in the lower portion, and a plurality of second apertures in a wall of the lower portion. Each second aperture and each first aperture may facilitate exit of compressed refrigerant from the lower portion. The flange may be integral with the cylindrically shaped lower portion and located on a top end of the cylindrically shaped lower portion. A bottom surface of the flange may seal the top end. The flange may include a plurality of recesses equidistantly located along a periphery of the flange. A location of each recess may correspond to a location of each second aperture for facilitating passage of compressed refrigerant exiting the second apertures. The spring supporter may be integral to the flange and located on a top surface of the flange. The spring supporter may be adapted to facilitate the first helical spring to rest on the top surface. The pulsation dampening assembly may be adapted to be displaceably configured between an operative state and an inoperative state. In the operative state, the first apertures and the second apertures may be aligned to facilitate exit of compressed refrigerant. In the inoperative state, the first apertures and the second apertures may not be aligned.

In some configurations, an inner side of the wall of the insert may form the second diameter portion and may include an upper shoulder, a retainer, and at least one vertical groove. The retainer may be integral with the inner side of the wall. The at least one vertical groove may extend from the upper shoulder to the retainer.

In some configurations, an outer side of the wall of the insert may form the second diameter portion and may include a ring located at a lower portion of the outer side of the wall. The ring may be integral with the outer side and the base. The ring and the base may be adapted to lock the insert in the outlet port.

In some configurations, the second helical spring may rest on the retainer of the second diameter portion.

In some configurations, an outer side of the wall of the cylindrically shaped lower portion may include at least one aligning element extending from the top end to the bottom end of the lower portion. The aligning element may be complementary to the vertical groove.

In some configurations, the outer side of the wall of the cylindrically shaped lower portion may engage with the inner side of the wall of the insert forming the second diameter portion.

In some configurations, the bottom end of the cylindrically shaped lower portion may rest on the second helical spring.

In some configurations, the recesses may be arcuate shaped recesses.

In some configurations, the supporter may be ring shaped and the outside of the wall of the supporter may engage with the inside of the first helical spring.

In some configurations, in the operative state, the first apertures and the second apertures may be co-axial.

In some configurations, in the inoperative state, the flange may rest on the upper shoulder of the second diameter portion.

In accordance with another aspect of the present disclosure, a pulsation dampening assembly for a compressor is provided. The compressor may include an outlet port configured for supplying compressed refrigerant from a compression mechanism of the compressor. The pulsation dampening assembly may include a pulsating disc and a spring. The pulsating disc and the spring may be disposed within the outlet port. The pulsating disc may include a plurality of apertures in fluid communication with the compression mechanism. The spring may include a first end engaging the pulsating disc and a second end engaging the outlet port. The pulsating disc may be translatably disposed within the outlet port between an operative state and an inoperative state.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1*a* is a scroll compressor having a discharge cavity for dampening pressure pulsations, in accordance with the prior art;

FIG. 1*b* is a scroll compressor having a direct discharge line coupled to the scroll compressor, in accordance with the prior art;

FIG. 2 is a graphical representation of discharge pulsations produced in a compressor;

FIG. 3*a* is a sectional view of an insert of a pulsation dampening assembly of the present disclosure;

FIG. 3*b* is a perspective view of a pulsating disc of a pulsation dampening assembly of the present disclosure;

FIG. 3*c* is a sectional view of the pulsation disc of FIG. 3*b;*

FIG. 3*d* is a sectional view of a pulsation dampening assembly of the present disclosure comprising the insert of FIG. 3*a* and the pulsating disc of FIG. 3*b* positioned in an outlet port of a compressor;

FIG. 3*e* is a sectional view of a pulsation dampening assembly functioning as a shutdown device for closing the outlet of a compressing device in accordance with the present disclosure;

FIG. 3*f* is a sectional view of another pulsation dampening assembly functioning as a shutdown device for closing the outlet of a compressing device in accordance with the present disclosure;

Corresponding reference numerals indicate corresponding parts throughout the several views of the drawings.

DETAILED DESCRIPTION

Figure 1A:
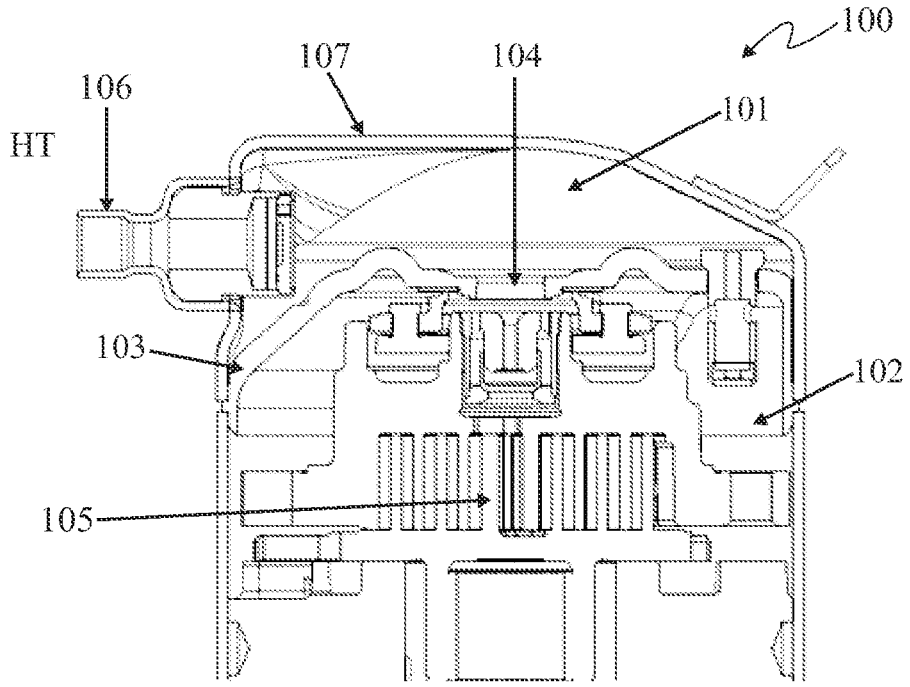
FIGURE 1a (PRIOR ART)

Discharge pressure pulsation comes from discontinued nature of refrigerant flow in compressors due to pulsating action of compressing means such as scroll disks, pistons, and the like. Several undesirable effects of discharge pulsations appear in the piping system and/or the equipment connected to the compressor or in the compressor itself. In order to absorb or dampen out discharge pulsations, a discharge cavity is typically provided at the outlet of the compressing means whereby the volume of the cavity facilitates reduction in discharge pulsations. Referring to FIG. 1*a*, a scroll compressor 100 as known in the art is illustrated. The scroll compressor 100, inter alia, comprises a discharge cavity 101, a suction cavity 102, a muffler plate 103 and a compression mechanism including two spiral wound disks 105 nested together. The discharge cavity 101 is formed in the compressor shell at the top end of the compressor between a top cap 107 and the muffler plate 103. The suction cavity 102 is used to suck in refrigerant which is then compressed by the movements of the spiral wound disks 105. Compressed refrigerant is discharged through an outlet 104 in the center into the discharge cavity 101 and finally out of the compressor through an outlet valve 106. As refrigerant in the compressor is compressed, its volume decreases and the pressure and temperature of refrigerant increases. Refrigerant is typically delivered outside the compressor in pulses instead of continuous flow. The movement of the spiral wound disks 105 and discharge of refrigerant in pulses produces discharge pulsations. The function of the discharge cavity 101 is to dampen these discharge pulsations. However, discharge pulsations and heat produced by increased refrigerant temperature due to compression considerably decrease the efficiency of the compressor.

The efficiency of the compressor 100 can be improved by preventing heat transfer (HT) from the discharge cavity 101 to the suction cavity 102 through the muffler plate 103. However this would require a large discharge cavity, whereby heat transfer can be avoided and discharge pulsations can also be reduced. A large discharge cavity will make the compressor bulky and difficult to service. Reducing the volume of the discharge cavity will be ineffective as it will increase discharge pulsations of the compressor.

Figure 1B:
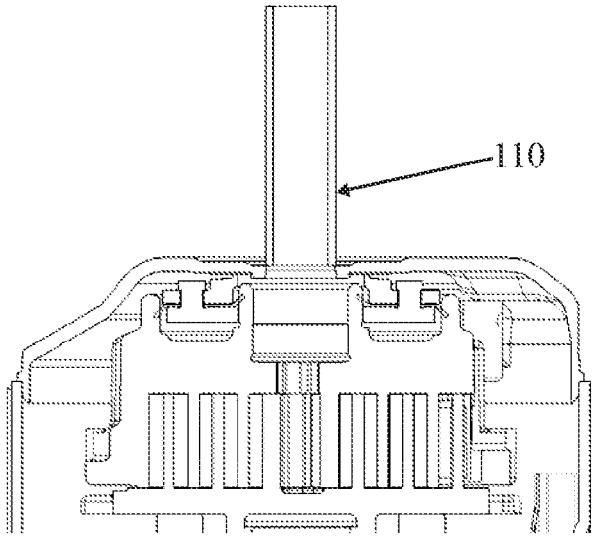
FIGURE 1b (PRIOR ART)

Alternatively, heat transfer can be reduced by replacing the discharge cavity by a direct discharge line. Referring to FIG. 1*b*, a direct discharge line 110 coupled to a scroll compressor, as known in the art, is illustrated. The direct discharge line 110 is used to restrict the area of muffler plate exposed to the discharge cavity, thereby preventing heat produced by increase in the temperature of refrigerant due to compression to be transferred to the suction cavity of the compressor. However, the direct discharge line has a fixed volume and is ineffective in dampening discharge pulsations.

Additionally, heat transfer and discharge pulsations can be reduced by replacing the discharge cavity by an external discharge muffler. U.S. Pub. No. 2009/0116977 discloses a scroll compressor coupled to an external discharge muffler having a valve therein for facilitating the flow of refrigerant. However, the shape and size of the muffler and the placement of the valve within the muffler leads to several geometrical constraints in coupling the muffler to the compressor and makes the muffler cumbersome to use.

Figure 2:
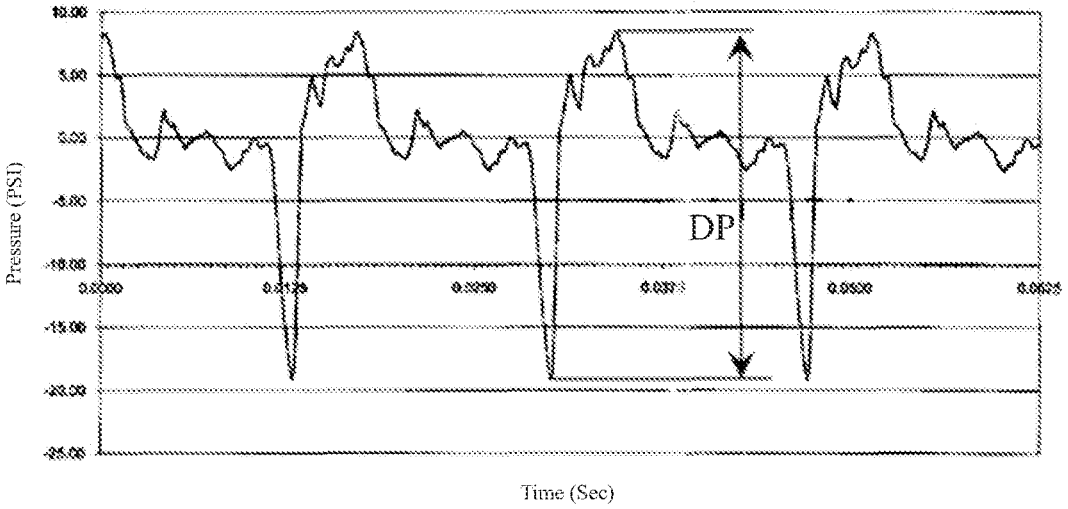

Referring to FIG. 2, a graphical representation of a discharge pulse produced in a compressor is illustrated. Discharge pulsation (DP) arises due to intermittent discharge/flow of refrigerant. As refrigerant in the compressor is compressed, its volume decreases and the pressure and temperature of refrigerant increases giving rise to intermittent discharge pulsation (DP).

Furthermore, scroll compressors are susceptible to reverse rotation typically during shutdown. Reverse rotation occurs when compressed refrigerant discharged through the outlet 104 of the compression mechanism of the scroll compressor 100 moves back through the outlet 104 into the compression mechanism, causing the spiral wound disks 105 of the scroll compressor 100 to move in reverse orbital direction in relation to each other. This is undesirable as it results in unwanted noise from the compressor and can also harm the internal components of the compressor. Reverse rotation can be avoided by deploying a shutdown device for closing the outlet 104 of the compressing means. The shutdown device is typically a discharge valve disposed within the outlet 104 of the compression mechanism. The discharge valve closes during shutdown of the compressor, thereby closing the outlet 104 of the compression mechanism. However, any malfunctioning of the shutdown device can needlessly close the outlet 104, thereby hindering the operation of the compressor and rendering the shutdown device ineffective and also leading to maintenance issues.

Thus to overcome these aforementioned limitations, the present disclosure envisages a pulsation dampening assembly to effectively dampen discharge pulsations of a compressor and at the same time increase the efficiency of the compressor and also prevent reverse rotation.

The pulsation dampening assembly of the present disclosure will now be described with reference to the embodiments shown in the accompanying drawings. The embodiments do not limit the scope and ambit of the disclosure. The description relates purely to the examples and preferred embodiments of the disclosed pulsation dampening assembly and its suggested applications.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Referring to FIG. 3*a*, a sectional view of an insert 350 of the pulsation dampening assembly of the present disclosure is illustrated. The insert 350 is cylindrically shaped and designed to be fitted within an outlet port configured in a shell/housing of a compressor and to be substantially retained therein. The wall 353 of the insert 350 comprises a through-hole defined by a first diameter portion 351 and a second diameter portion 352. The wall 353 of the insert that forms the first diameter portion 351 comprises a plurality of first apertures 354, equidistantly spaced apart on the wall 353 and adjacent to the second diameter portion 352. Integral with the wall 353 is a base 356. An outer side of the wall 353 that forms the second diameter portion 352 comprises a ring 355 located at a lower portion of the outer side of the wall 353, thereby making the ring 355 integral with the outer side of the wall 353 and the base 356. An inner side of the wall 353 that forms the second diameter portion 352 further comprises an upper shoulder 357 integral with the inner side of the wall 353 at the upper part of the second diameter portion 352 and a retainer 358 integral with the inner side of the wall 353 at the lower part of the second diameter portion 352. The inner side of the wall 353 that forms the second diameter portion 352 further comprises at least one vertical groove 359 extending from the upper shoulder 357 to the retainer 358. Typically, the inner side of the wall 353 that forms the second diameter portion 352 comprises multiple equidistantly spaced apart vertical grooves 359.

Referring to FIGS. 3*b* and 3*c*, a schematic representation of a pulsating disc 300 of the pulsation dampening assembly of the present disclosure and a sectional view of the pulsation disc of FIG. 3*b* respectively, is illustrated. The pulsating disc 300 comprises a cylindrically shaped lower portion 301, a flange 305 and a spring supporter 307. The cylindrically shaped lower portion 301, the flange 305 and the spring supporter 307 may be integrally formed portions. The cylindrically shaped lower portion 301 has an open bottom end for facilitating entry of a compressed refrigerant in the lower portion 301. The wall 302 of the cylindrically shaped lower portion 301 comprises a plurality of second apertures 303, equidistantly spaced apart on the wall 302, whereby each second aperture 303 and each first aperture 354 facilitates exit of compressed refrigerant from the lower portion 301. The wall 302 further comprises at least one aligning element 304 on an outer side of the wall 302 and extending from a top end to the bottom end of the cylindrically shaped lower portion 301. The aligning element 304 is complementary to the vertical groove 359 of the insert 350, thereby restricting rotational movement of the pulsating disc 300. Typically, the wall 302 comprises multiple aligning elements 304 equidistantly spaced apart on the outer side of the wall 302, wherein the aligning elements 304 are complementary to the vertical grooves 359 of the insert 350. The flange 305 integral to the cylindrically shaped lower portion 301 is located on the top end of the cylindrically shaped lower portion 301 whereby a bottom surface of the flange 305 seals the top end of the cylindrically shaped lower portion 301. The flange 305 comprises multiple recesses 306 equidistantly located along the periphery of the flange 305. For example only, the multiple recesses 306 may be arcuate in shape. The location of each recess 306 corresponds to the location of each second aperture 303 for facilitating passage of compressed refrigerant exiting the second aperture 303. The spring supporter 307 is ring shaped and integral to the top surface of the flange 305.

Figure 3D:
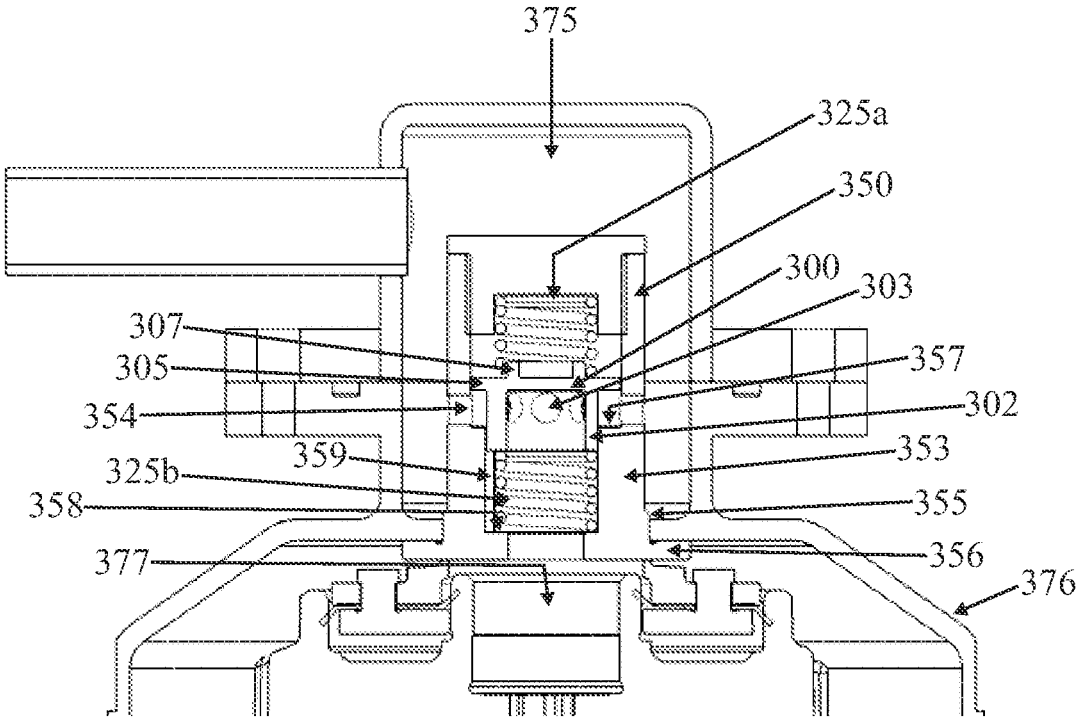

Referring to FIG. 3*d*, a sectional view of the pulsation dampening assembly comprising the insert of FIG. 3*a* and the pulsating disc of FIG. 3*b* positioned in an outlet port of a compressor is illustrated. The compressor includes an outlet port 375 defined in a shell/housing 376 of the compressor. The outlet port 375 is defined on the top portion of the shell 376 right above an outlet 377 of the compressing means of the compressor. The pulsation dampening assembly, having the pulsating disc 300 placed between a pair of co-axially spaced apart helical springs 325*a*, 325*b* in the through-hole of the insert 350, is fitted in the outlet port 375. The base 356 abuts the operative inside of compressor shell/housing 375 when the insert 350 is operatively fitted within the outlet port 375. The ring 355 and the base 356 together lock the insert 350 within the cavity of the outlet port 375. The first helical spring 325*a* of the pair rests on the top surface of the flange 305 of the pulsating disc 300. The spring supporter 307 integral to top surface of the flange 305 facilitates the first helical spring 325*a* to rest on the top surface of the flange 305, wherein the outside of the supporter wall engages with the inside of the first helical spring 325*a*. The cylindrically shaped portion 301 of the pulsating disc 300 rests on the second helical spring 325*b* of the pair, wherein the outer side of the wall 302 of the cylindrically shaped lower portion 301 engages with the inner side of the wall 353 of the insert 350 that forms the second diameter portion 352 and each aligning element 304 slides in each groove 359. The second helical spring 325*b* in turn rests on the retainer 358.

The pulsation dampening assembly is configured to be displaceable between an operative state wherein the first apertures 354 and the second apertures 303 are aligned to facilitate exit of compressed refrigerant, and an inoperative state wherein the first apertures 354 and the second apertures 303 are not aligned and the flange 305 rests on the upper shoulder 357. Typically, the first apertures 354 and the second apertures 303 are generally coaxial in the operative state and non-coaxial in the inoperative state. In the operative state, compressed refrigerant discharged from the outlet 377 of compressing means hits the pulsating disc 300 and pushes it against the spring force. The pulsating force exerted by discharged refrigerant will be opposed by the springs 325*a*, 325*b* and all the pulsation energy will be absorbed by the springs 325*a*, 325*b* thereby reducing discharge pulsations considerably.

Figure 3E:
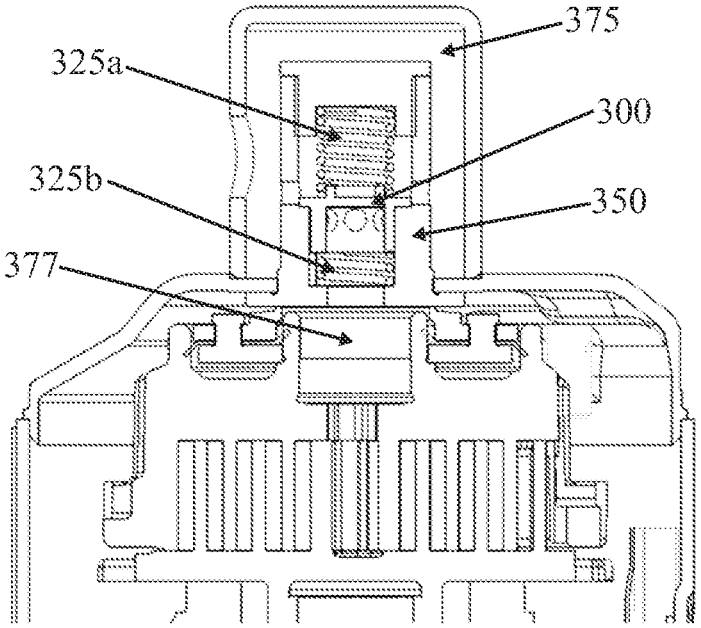

Referring to FIG. 3*e*, a sectional view of a pulsation dampening assembly functioning as a shutdown device, in accordance with an embodiment of the present disclosure, for closing an outlet of a compressing means in a compressor is illustrated. The pulsation dampening assembly, having the pulsating disc 300 placed between a pair of co-axially spaced apart helical springs 325*a*, 325*b* in the through-hole of the insert 350, is fitted in the outlet port 375 of the compressor. The height of the top spring 325*a* and the bottom spring 325*b* of the pulsation dampening assembly 300 is changed. The height of the top spring 325*a* is increased and the height of the bottom spring 325*b* is decreased to keep the pulsation dampening assembly in normally closed (NC) position in the inoperative state, thereby enabling the pulsation dampening assembly 300 to function as a shutdown device to close the outlet 377 of the compressing means in the compressor.

Figure 3F:
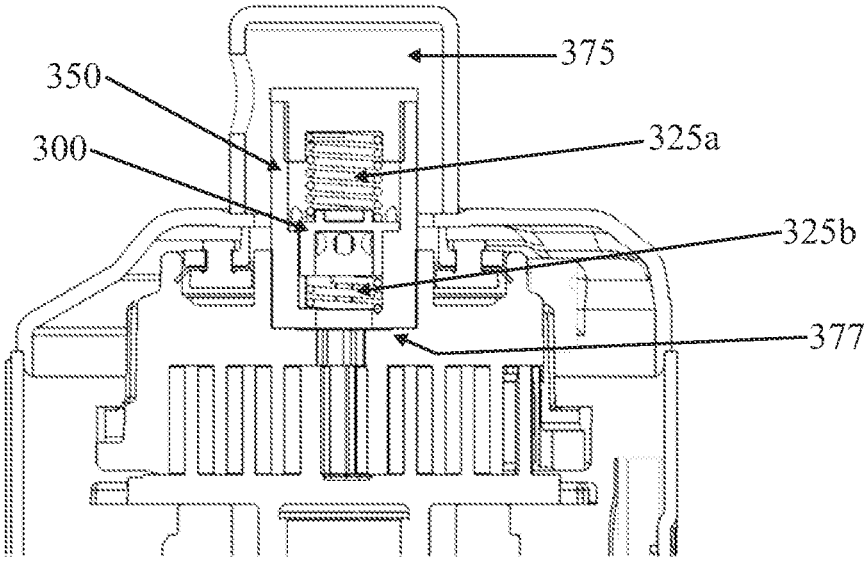

Referring to FIG. 3*f*, a sectional view of a pulsation dampening assembly functioning as a shutdown device, in accordance with another embodiment of the present disclosure, for closing an outlet of a compressing means in a compressor is illustrated. The pulsation dampening assembly, having the pulsating disc 300 placed between a pair of co-axially spaced apart helical springs 325*a*, 325*b* in the through-hole of the insert 350, is fitted in the outlet 377 of the compressing means of the compressor. The height of the top spring 325*a* and the bottom spring 325*b* of the pulsation dampening assembly 300 is changed. The height of the top spring 325*a* is increased and the height of the bottom spring 325*b* is decreased to keep the pulsation dampening assembly in normally closed (NC) position in the inoperative state, thereby enabling the pulsation dampening assembly 300 to function as a shutdown device to close the outlet 377 of the compressing means in the compressor.

Figure 4:
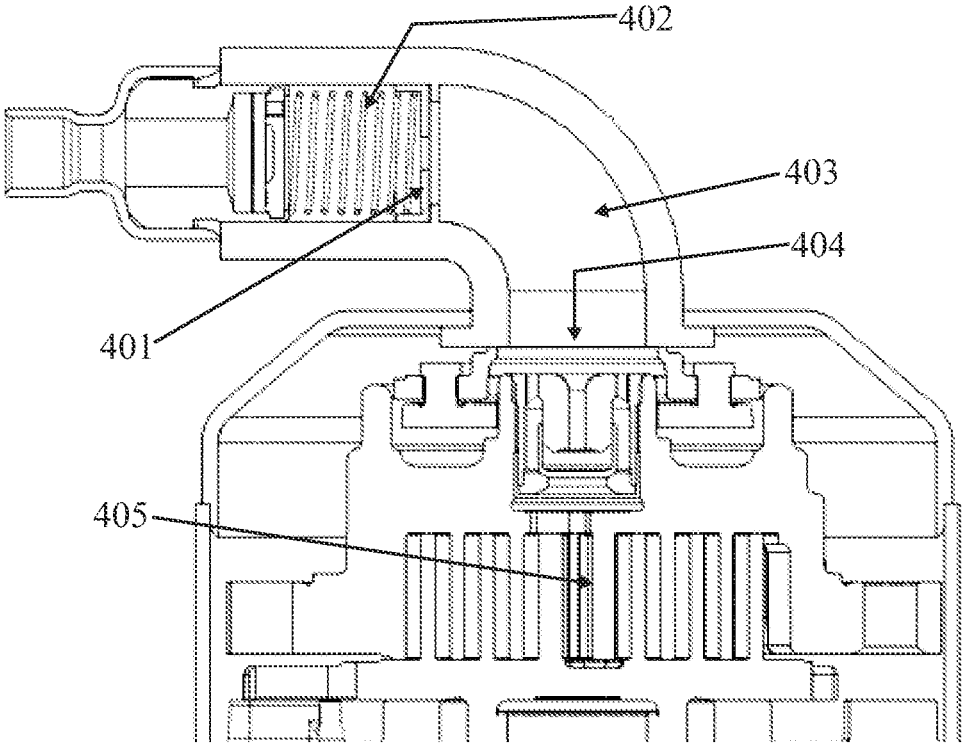
FIG. 4 is a sectional view of another pulsation dampening assembly positioned in an outlet port of a compressor in accordance with the present disclosure.

Referring to FIG. 4, a sectional view of a pulsation dampening assembly in accordance with an embodiment of the present disclosure, positioned in an outlet port of a compressor, is illustrated. A pulsation dampening assembly comprising a floating pulsating disc 401 supporting a helical spring 402 is used in the discharge path 403 of the compressor. The pulsating discharge refrigerant from an outlet 404 of a compression mechanism 405 of the compressor hits the floating pulsating disc 401 and pushes the disc 401 against the spring force. Thus all the pulsation energy will be absorbed by the spring 402, thereby reducing discharge pulsations considerably. Moreover, the pressure of refrigerant will also be reduced, and refrigerant with uniform pressure will be released from an outlet valve of the compressor.

Figure 5:
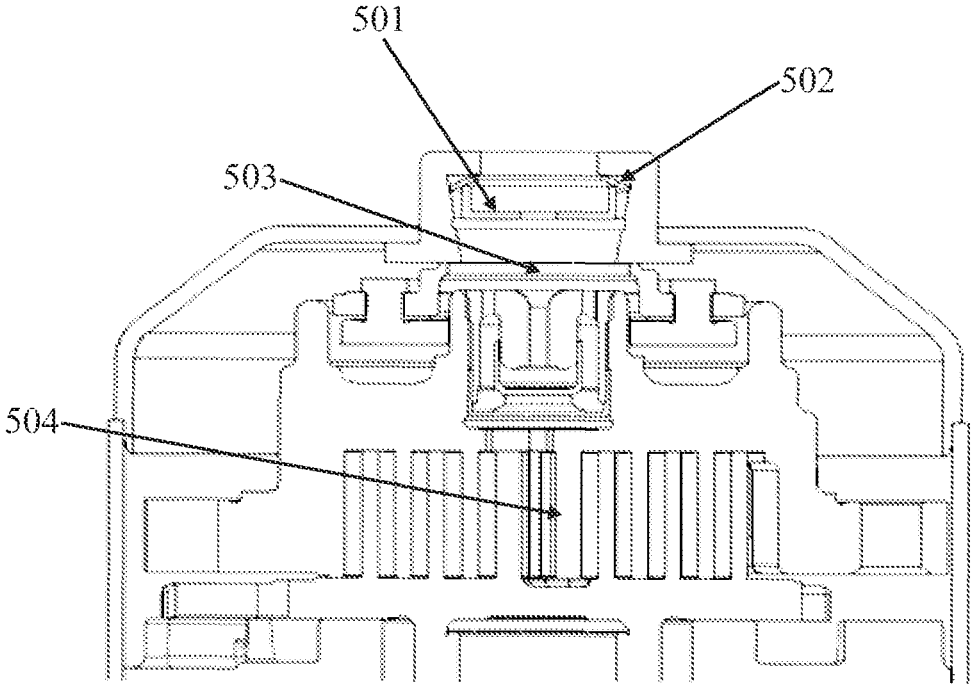
FIG. 5 is a sectional view of another pulsation dampening assembly positioned in an outlet port of a compressor in accordance with the present disclosure.

Referring to FIG. 5, a sectional view of a pulsation dampening assembly in accordance with another embodiment of the present disclosure, positioned in an outlet port of a compressor, is illustrated. A pulsation dampening assembly comprising a floating pulsating disc 501 supporting a leaf spring 502 is used in the discharge path of the compressor. The disc 501 coupled to the leaf spring 502 is fitted in an aperture defined in a shell of the compressor. The aperture is defined on the top portion of the shell right above an outlet 503 of a compression mechanism 504 of the compressor. The pulsating discharge refrigerant from the outlet 503 hits the floating pulsating disc 501 and pushes the disc 501 against the spring force. Thus all the pulsation energy will be absorbed by the leaf spring 502, thereby reducing discharge pulsations considerably. Moreover, the pressure of refrigerant will also reduce and refrigerant with uniform pressure will be released from an outlet valve/port of the compressor.

Thus discharge pulsation dampening is achieved by the aforementioned spring operated floating discs.

The springs 402, 502 used in the aforementioned embodiments, are specially designed to ensure dampening of refrigerant discharge pulsations. The design calculations considered to achieve the required stiffness of the helical spring 502 are as described below:

$$K=F/\delta=Gd/(8C^3n)(C^2/(C^2+0.5))$$

wherein $C$=Spring Index $D/d$ $d$=wire diameter($m$)

$D$=Spring diameter=$(D_i+D_o)/2$($m$)

$D_i$=Spring inside diameter($m$)

$D_o$=Spring outside diameter($m$)

$D_N$=Spring inside diameter(loaded)($m$)

$E$=Young's Modulus($N/m^2$)

$F$=Axial Force($N$)

$G$=Modulus of Rigidity($N/m^2$)

However, the term $(C^2/(C^2+0.5))$ which approximates to 1 can be ignored. Hence, $$K=F/\delta=Gd/(8C^3\,n)$$

The results of tests performed on the pulsation dampening assembly of the present disclosure are provided below. The results are shown as a percentage variation from a baseline compressor as depicted in FIG. 1. Efficiency gain is ranging from 1% to 13% across operating points Minimum gain in EER (Energy Efficiency Ratio)=1%

Maximum gain in EER=13%

Minimum gain in Heat Capacity=0.92%

Maximum gain in Heat Capacity=12%

Minimum gain in Mass Flow=0.92%

Maximum gain in Mass Flow=12%

Furthermore, power consumption is also reduced.

Further, the results of sound and pulse tests performed on the pulsation dampening assembly of the present disclosure show that a significant drop of 72% in pressure of discharge pulse is achieved by the pulsation dampening assembly of present disclosure as compared to the direct discharge line, as illustrated in FIG. 1*b*.

Thus the results clearly indicate improved performance of the pulsation dampening assembly of the present dislcosure.

Dampening of discharge pulsations is also achieved by additional embodiments.

Figure 6:
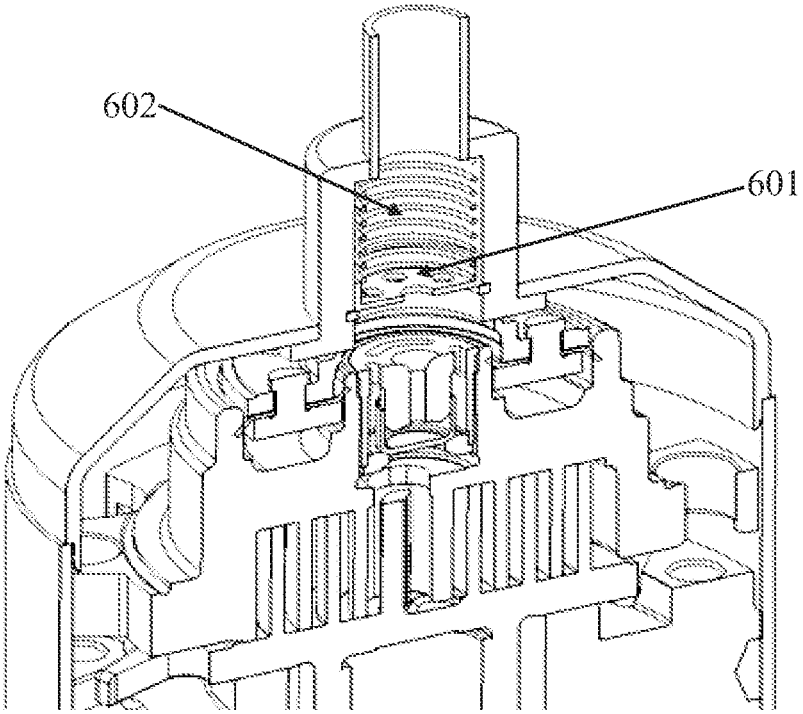
FIG. 6 is a sectional view of another pulsation dampening assembly positioned in an outlet port of a compressor in accordance with the present disclosure.

Referring to FIG. 6, a sectional view of a pulsation dampening assembly positioned in an outlet port of a compressor in accordance with an embodiment of the present disclosure is illustrated. Vertical discharge path is used to discharge compressed refrigerant from the compressor. A pulsation dampening assembly comprising a floating pulsating disc 601 supporting a helical spring 602 above the disc 601 is used in the discharge path of the compressor. The pulsation energy of compressed refrigerant will be absorbed by the spring 602, thereby reducing discharge pulsations. Moreover, the pressure of refrigerant will also reduce and refrigerant with uniform pressure will be released from an outlet port of the compressor.

Figure 7:
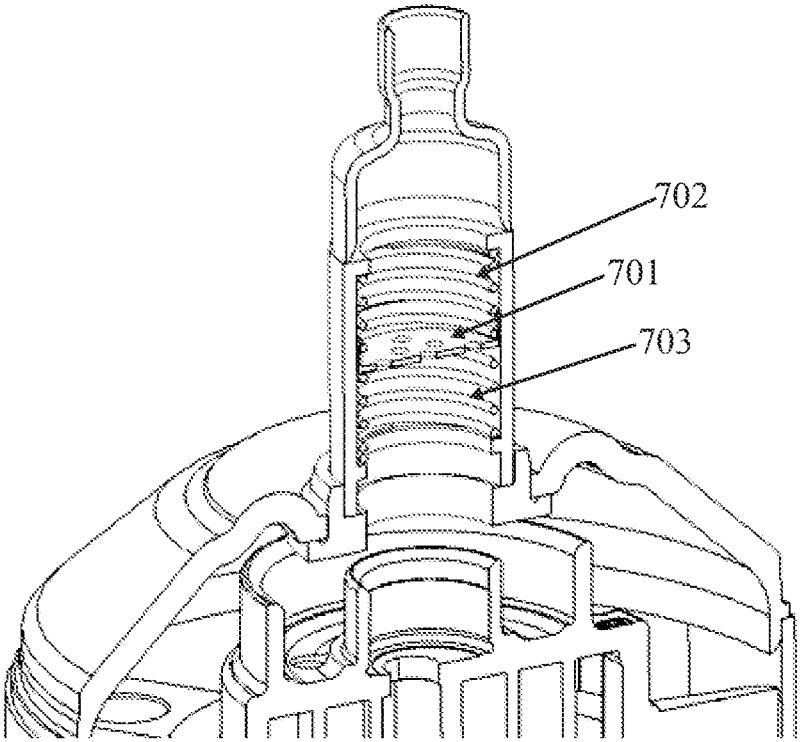
FIG. 7 is a sectional view of another pulsation dampening assembly positioned in an outlet port of a compressor in accordance with the present disclosure.

Referring to FIG. 7, a sectional view of a pulsation dampening assembly positioned in an outlet port of a compressor, in accordance with another embodiment of the present disclosure is illustrated. Vertical discharge path is used to discharge compressed refrigerant from the compressor. A pulsation dampening assembly comprising a floating pulsating disc 701 with a first helical spring 702 and a second helical spring 703 are used in the discharge path of the compressor. The first helical spring 702 is positioned above the disc 701 and the second helical spring 703 is positioned below the disc 701. The pulsation energy of compressed refrigerant will be absorbed by a portion of the first spring 702 above the disc 701 thereby inducing positive pulsation dampening. The pressure of refrigerant will also reduce and refrigerant with uniform pressure will be released from an outlet port of the compressor. Furthermore, the pulsation energy of rush back refrigerant will be absorbed by a portion of the second spring 703 below the disc 701 thereby inducing negative pulsation dampening. Thus the dual positioning of the springs above and below the disc will considerably reduce discharge pulsations.

Figure 8:
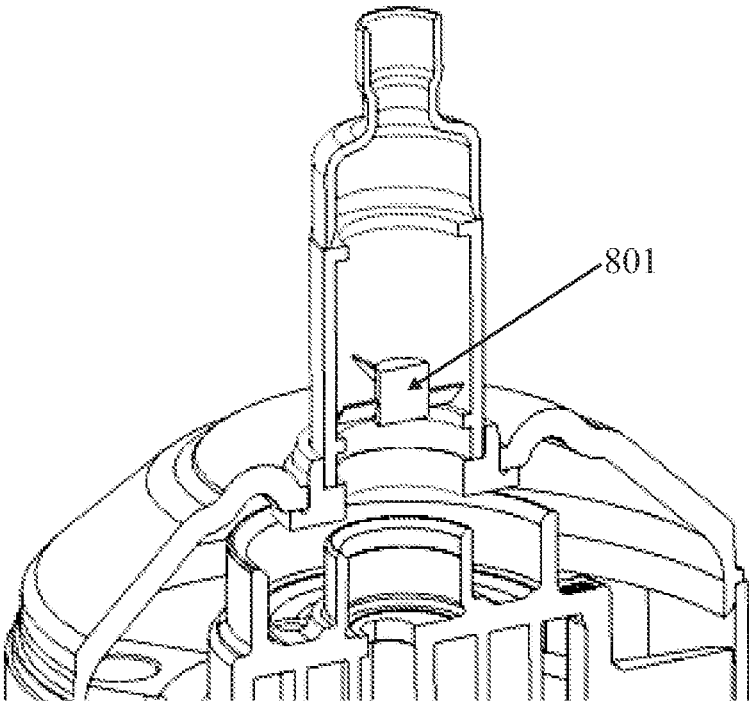
FIG. 8 is a sectional view of another pulsation dampening assembly positioned in an outlet port of a compressor in accordance with the present disclosure.

Referring to FIG. 8, a sectional view of a pulsation dampening assembly in accordance with yet another embodiment of the present disclosure, positioned in an outlet port of a compressor is illustrated. Vertical discharge path is used to discharge compressed refrigerant from the compressor. A pulsation dampening assembly comprising a fan 801 is used in the discharge path of the compressor. The pulsation energy of compressed refrigerant flowing axially over the fan will be reduced by the movement of the blades of the fan 801, thereby reducing discharge pulsations. Moreover, the pressure of refrigerant will also reduce and refrigerant with uniform pressure will be released from an outlet port of the compressor. The fan 801 placed in the discharge path of refrigerant enables reduction in discharge pulsations, both, due to compressed refrigerant released from an outlet of compressing means, as well as rush back refrigerant. The blades of the fan 801 are specifically designed to reduce pulsations in both directions.

Figure 9:
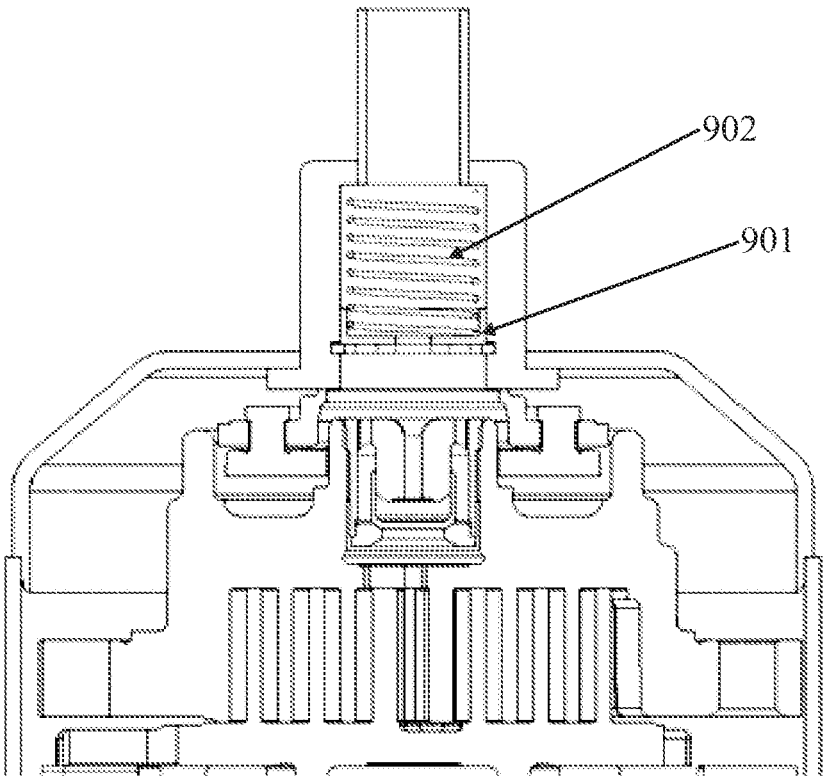
FIG. 9 is a sectional view of another pulsation dampening assembly positioned in an outlet port of a compressor in accordance with the present disclosure.

Referring to FIG. 9, a sectional view of a pulsation dampening assembly in accordance with one more embodiment of the present disclosure, positioned in an outlet port of a compressor. Vertical discharge path is used to discharge compressed refrigerant from the compressor. A pulsation dampening assembly comprising a floating pulsating disc 901 supporting a helical spring 902 above the disc 901 is used in the discharge path of the compressor. The pulsation energy of compressed refrigerant will be absorbed by the spring, thereby reducing discharge pulsations. Moreover, the pressure of refrigerant will also reduce and refrigerant with uniform pressure will be released from an outlet port of the compressor.

Throughout this specification the word "comprise," or variations such as "comprises" or "comprising," will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the invention to achieve one or more of the desired objects or results.

Any discussion of documents, acts, materials, devices, articles or the like that has been included in this specification is solely for the purpose of providing a context for the invention. It is not to be taken as an admission that any or all of these matters form part of the prior art base or were common general knowledge in the field relevant to the invention as it existed anywhere before the priority date of this application.

The numerical values mentioned for the various physical parameters, dimensions or quantities are only approximations and it is envisaged that the values higher/lower than the numerical values assigned to the parameters, dimensions or quantities fall within the scope of the invention, unless there is a statement in the specification specific to the contrary.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A pulsation dampening assembly for compressors, said pulsation dampening assembly adapted to be disposed in an outlet port configured in a housing of a compressor for supplying compressed refrigerant outside the compressor, said assembly comprising:

an insert adapted to be attached to the outlet port, said insert comprising a base, a wall extending from said base, and a through-hole defined by a first diameter portion and a second diameter portion of said wall, wherein said first diameter portion comprises a plurality of first apertures located adjacent to said second diameter portion, said base abutting the housing of the compressor when said insert is attached within the outlet port;

a first helical spring and a second helical spring co-axially spaced apart within said through-hole of said insert; and a pulsating disc positioned between said first and second helical springs in said through-hole, said disc comprising:

a cylindrically shaped lower portion having an open bottom end for facilitating entry of compressed refrigerant in said lower portion and a plurality of second apertures in a wall of said lower portion, each second aperture and each first aperture facilitating exit of compressed refrigerant from said lower portion;

a flange integral with said cylindrically shaped lower portion and located on a top end of said cylindrically shaped lower portion whereby a bottom surface of said flange seals said top end, said flange comprising a plurality of recesses equidistantly located along a periphery of said flange, a location of each recess corresponding to a location of each second aperture for facilitating passage of compressed refrigerant exiting said second apertures; and a spring supporter integral to said flange and located on a top surface of said flange, said supporter adapted to facilitate said first helical spring to rest on said top surface;

wherein said pulsation dampening assembly is adapted to be displaceably configured between an operative state wherein said first apertures and said second apertures are aligned to facilitate exit of compressed refrigerant and an inoperative state wherein said first apertures and said second apertures are not aligned.

2. The pulsation dampening assembly of claim 1, wherein an inner side of the wall of said insert forming said second diameter portion comprises an upper shoulder and a retainer integral with said inner side of the wall and at least one vertical groove extending from said upper shoulder to said retainer.

3. The pulsation dampening assembly of claim 2, wherein said second helical spring rests on the retainer of said second diameter portion.

4. The pulsation dampening assembly of claim 2, wherein an outer side of the wall of said cylindrically shaped lower portion comprises at least one aligning element extending from said top end to said bottom end of said lower portion, said aligning element complementary to the vertical groove.

5. The pulsation dampening assembly of claim 2, wherein in said inoperative state, said flange rests on the upper shoulder of said second diameter portion.

6. The pulsation dampening assembly of claim 1, wherein an outer side of the wall of said insert forming said second diameter portion comprises a ring located at a lower portion of said outer side of the wall, said ring being integral with said outer side and said base, said ring and said base adapted to lock said insert in said outlet port.

7. The pulsation dampening assembly of claim 1, wherein the outer side of the wall of said cylindrically shaped lower portion engages with the inner side of the wall of said insert forming said second diameter portion.

8. The pulsation dampening assembly of claim 1, wherein said bottom end of said cylindrically shaped lower portion rests on said second helical spring.

9. The pulsation dampening assembly of claim 1, wherein said recesses are arcuate shaped recesses.

10. The pulsation dampening assembly of claim 1, wherein said supporter is ring shaped and the outside of the wall of said supporter engages with the inside of said first helical spring.

11. The pulsation dampening assembly of claim 1, wherein in said operative state, id first apertures and said second apertures are co-axial.

12. A pulsation dampening assembly for a compressor having an outlet port configured for supplying compressed refrigerant from a compression mechanism of said compressor, said pulsation dampening assembly comprising:

a pulsating disc disposed within said outlet port and having a first plurality of apertures in fluid communication with said compression mechanism; and a spring disposed within said outlet port and having a first end engaging a first side of said pulsating disc and a second end engaging said outlet port, wherein said pulsating disc is translatably disposed within said outlet port between an operative state and an inoperative state, and wherein the pulsating disc includes a cylindrically shaped lower portion, a flange, and a spring supporter, the cylindrically shaped lower portion having an open bottom end and a second plurality of apertures in a wall of said lower portion, and the flange including a plurality of recesses equidistantly located along a periphery of the flange.

13. The pulsation dampening assembly of claim 12, further comprising an insert having a second plurality of apertures, wherein said first plurality of apertures is in fluid communication with said second plurality of apertures in the operative state, and wherein said first plurality of apertures is fluidly isolated from said second plurality of apertures in the inoperative state.

14. The pulsation dampening assembly of claim 12, further comprising a second spring disposed within said outlet port, said second spring having a first end engaging a second side of said pulsating disc and a second end engaging said outlet port.

15. The pulsation dampening assembly of claim 12, wherein said spring includes a leaf spring.

16. The pulsation dampening assembly of claim 12, wherein, the flange is integral with the cylindrically shaped lower portion and located on a top end of the cylindrically shaped lower portion, a location of each recess corresponds to a location of each aperture of the second plurality of apertures, and the spring supporter is integral to the flange and located on a top surface of the flange.

17. A pulsation dampening assembly for a compressor having a port configured for supplying compressed refrigerant from an outlet of a compression mechanism of said compressor, said pulsation dampening assembly comprising:

an insert disposed within said port and defining a through-hole having a first diameter portion and a second diameter portion, wherein the said first diameter portion comprises a plurality of first apertures located adjacent to said second diameter portion;

a first helical spring disposed said through-hole of said insert; and a pulsating disc disposed in said through-hole, said disc comprising:

a cylindrically shaped lower portion having an open bottom end for facilitating entry of compressed refrigerant in said lower portion and a plurality of second apertures in a wall of said lower portion, each second aperture and each first aperture facilitating exit of compressed refrigerant from said lower portion;

a flange integral with said cylindrically shaped lower portion, a bottom surface of said flange configured to seal said open bottom end, said flange comprising a plurality of recesses equidistantly located along a periphery of said flange, a location of each recess corresponding to a location of each second aperture for facilitating passage of compressed refrigerant exiting said second apertures; and a spring supporter integral to said flange and located on a top surface of said flange, said first helical spring disposed on said top surface, wherein said pulsation dampening assembly is adapted to be displaceably configured between an operative state wherein said first apertures and said second apertures are aligned to facilitate exit of compressed refrigerant and an inoperative state wherein said first apertures and said second apertures are not aligned.

18. The pulsation dampening assembly of claim 17, wherein said insert abuts an inner portion of the housing of the compressor when said insert is attached within the port.

19. The pulsation dampening assembly of claim 17, wherein said insert is disposed within said outlet of the compression mechanism when said insert is attached within the port.

20. The pulsation dampening assembly of claim 17, wherein said first helical spring is disposed within said first diameter portion of said through-hole, said first diameter portion being greater than said second diameter portion.

* * * * *